US006688218B2

(12) United States Patent
Svenka et al.

(10) Patent No.: US 6,688,218 B2
(45) Date of Patent: Feb. 10, 2004

(54) CALENDER

(75) Inventors: Peter Svenka, Grefrath (DE); Bernhard Brendel, Grefrath (DE); Jörg Prey, Tönisvorst (DE); Helmut Kox, Moers (DE)

(73) Assignee: Eduard Küsters Maschinenfabrik GmbH & CO KG, Krefeld (DE)

( * ) Notice: Subject to any disclaimer, the term of this patent is extended or adjusted under 35 U.S.C. 154(b) by 0 days.

(21) Appl. No.: 10/003,739

(22) Filed: Nov. 14, 2001

(65) Prior Publication Data

US 2002/0134255 A1 Sep. 26, 2002

(30) Foreign Application Priority Data

Mar. 22, 2001 (EP) ..... 01107146

(51) Int. Cl.[7] ..... B30B 3/04
(52) U.S. Cl. ..... 100/155 R; 100/161; 100/162 R
(58) Field of Search ..... 100/162 R, 163 A, 100/155 R, 160, 161, 168, 172, 173, 327, 331; 72/232

(56) References Cited

U.S. PATENT DOCUMENTS 4,326,456 A * 4/1982 Kankaanpaa ..... 100/41
4,332,191 A 6/1982 Kankaanpaa
4,366,752 A * 1/1983 Koski ..... 100/162 R
4,890,551 A * 1/1990 Dahl et al. ..... 100/163 A
5,655,442 A * 8/1997 Conrad et al. ..... 100/331
5,662,037 A * 9/1997 van Haag ..... 100/331
5,746,124 A 5/1998 Kayser
5,806,415 A * 9/1998 Lipponen et al. ..... 100/35

FOREIGN PATENT DOCUMENTS

DE 199 40 897 C1 * 11/2000
EP 0732443 B1 10/1988

* cited by examiner

*Primary Examiner*—Allen Ostrager
*Assistant Examiner*—Jimmy Nguyen
(74) *Attorney, Agent, or Firm*—Townsend and Townsend and Crew LLP

(57) ABSTRACT

A calender for treating a paper web, having at least one roll stack capable of being loaded from the end and in each case comprising a top and bottom end roll and a plurality of intermediate rolls, which are jointly arranged in a roll stack plane, and the rolls including hard and soft rolls in order to form operating nips in the form of soft nips, wherein each soft roll which forms an intermediate roll has a greater diameter than a soft roll which forms an end roll.

9 Claims, 5 Drawing Sheets

CALENDER

Figure 1:
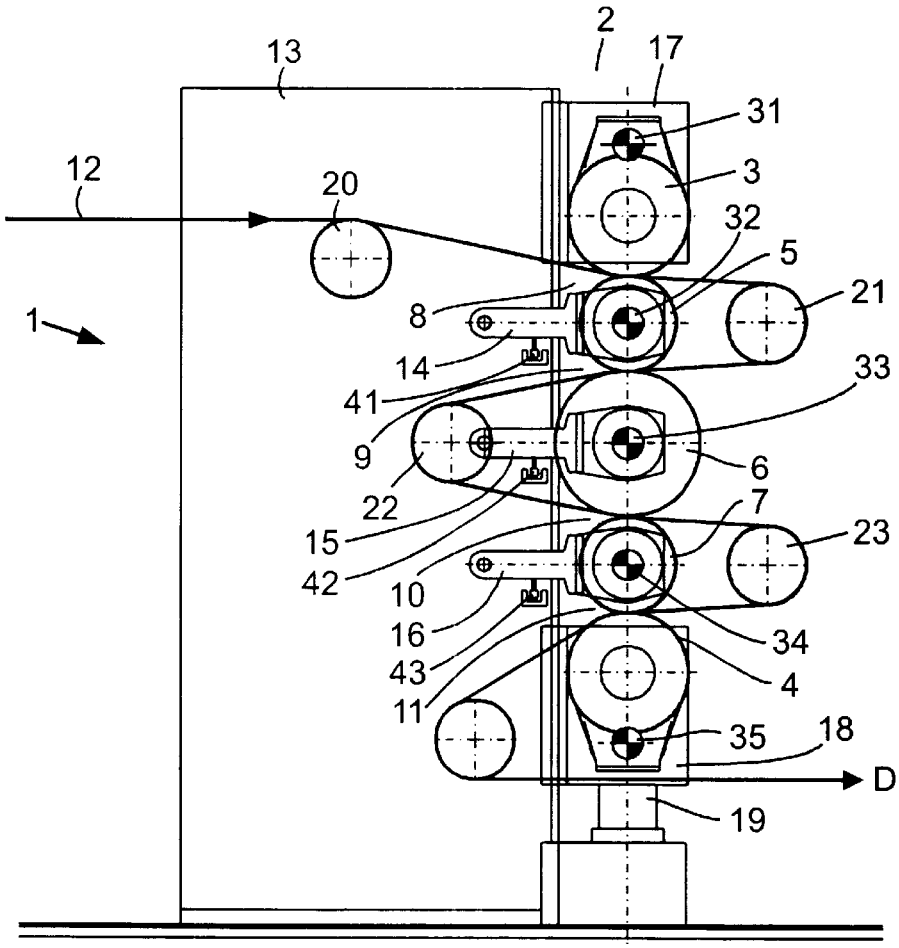

The invention relates to a calender for treating a paper web, in particular for papers with medium up to high demands on surface smoothness and gloss.

A calender of this type is used for the final treatment of a paper web, in order that the latter is given a desired value of smoothness, gloss, thickness, bulk and the like. The use of hard and soft rolls permits the formation of soft nips, which effect a significantly more uniform densification than the hard nips formed by two hard rolls. However, the shorter service lives of the soft rolls, caused by wear, are a disadvantage, as a result of which the outlay on maintenance and the associated down times of the known calenders are high. The rapid wear of the soft rolls, especially the roughening of the same by the roughness of the paper web surface, results primarily when calendering higher-quality papers, such as in particular those having a high filler content or coated papers which, in order to be easily printable, must have a high smoothness and a high uniformity of smoothness.

EP 0 732 443 B1 discloses the practice of replacing the resilient cover of the soft rolls by a cover which is highly insensitive to marking. However, such covers are expensive, which is particularly important taking into account the low service lives of the soft rolls.

It is therefore an object of the invention to provide a calender which supplies very good calendering results and, at the same time, is cheaper to operate.

This provides a calender for treating a paper web which reduces the disadvantages of the rapid wear of the soft rolls in that, by means of a mechanical solution with greater diameters of the soft intermediate rolls with respect to the diameter of the soft end rolls, it increases the service lives of the soft intermediate rolls in order for the latter to be matched to the service lives of the soft end rolls. Down times of the calender for maintenance actions can thus be reduced, since according to the invention all the soft rolls in a calender stack have substantially the same service lives. The maintenance actions on the soft rolls are collected together as a result of the fact that they can be performed at the same time. According to the invention, it has been established that the intermediate rolls which are rolled over twice and which, on account of this higher loading, otherwise wear more rapidly as compared with the soft end rolls, which are rolled over once, wear more slowly if the diameter is enlarged. The use of less expensive roll covers therefore becomes possible again. Calenders for producing highly glossy papers become cheaper to produce and to operate. High production speeds can be realized.

The configuration according to the invention is also important because the use of soft end rolls in a roil stack is advantageous. The use of soft end rolls permits the setting of higher temperatures in the first and/or last nip. The end rolls are usually deflection controlled rolls with an internal construction which makes the setting of high temperatures more difficult. On the other hand, if the second roll is a hard roll, then it is possible for high temperatures to be run with the latter.

According to the invention, it has been established that only a relatively low increase in the diameter of the soft intermediate rolls is sufficient to match their service lives to those of the soft end rolls. The diameter of a soft intermediate roll is advantageously 1.1 to 1.5 times the diameter of a soft end roll, although the intermediate rolls are rolled over twice as compared with the soft end rolls. The enlargement of the diameter of the soft intermediate rolls in the aforementioned sector depends on the paper quality, in particular the stock composition, the coating color composition or the filler content of the paper web to be treated. The higher the amount of paper web constituents which cause roughness, the greater must the diameter of the soft intermediate rolls be selected.

All rolls in a roll stack preferably have their own high-performance or power drive, in order in this way to minimize the shear stresses in the individual nips. These shear stresses, which otherwise arise from the transfer of the drive power to the rolls by the paper web running into the nips and increase the wear on the soft intermediate rolls, are avoided. The enlargement of the diameter of the intermediate rolls can then be small.

It is preferable if, depending on the web running speed, the diameter of a soft intermediate roll is selected in such a way that the loadings frequency is 20 to 25 Hz.

The configuration according to the invention permits the use of the known roll loading and/or relief systems in order to be able to set specific linear loads in the individual soft nips, so that it is possible to operate with individual linear-load characteristic curves.

The configuration according to the invention moreover permits the use of any desired roll-stack configurations. For two-side treatment of a paper web, two of the roll stacks according to the invention can be connected one behind the other, the first roll stack being used to treat one side of the paper web and the other roll stack being used to treat the other side of the paper web. Following the basic principle of the calender designer, of managing with as few rolls as possible, irrespective of the paper quality in order in this way to keep the maintenance outlay and the operating costs low, two roll stacks connected one behind the other and each having five rolls, whose top and bottom end rolls are soft rolls, are preferred. In order to optimize the guidance of the paper web, when two separate roll stacks are used, these are arranged beside each other with a vertical offset, as a result of which the path length of the paper web between the two roll stacks is shortened and the threading of the paper web is simplified. Undesired changes in the paper web can be avoided.

Alternatively, for two-side treatment of the paper web, the at least one roll stack can have six or eight rolls, the top and bottom end rolls being soft rolls and a reversing nip being formed between two soft intermediate rolls.

Further refinements of the invention are to be taken from the following description and the subclaims.

Figure 2:
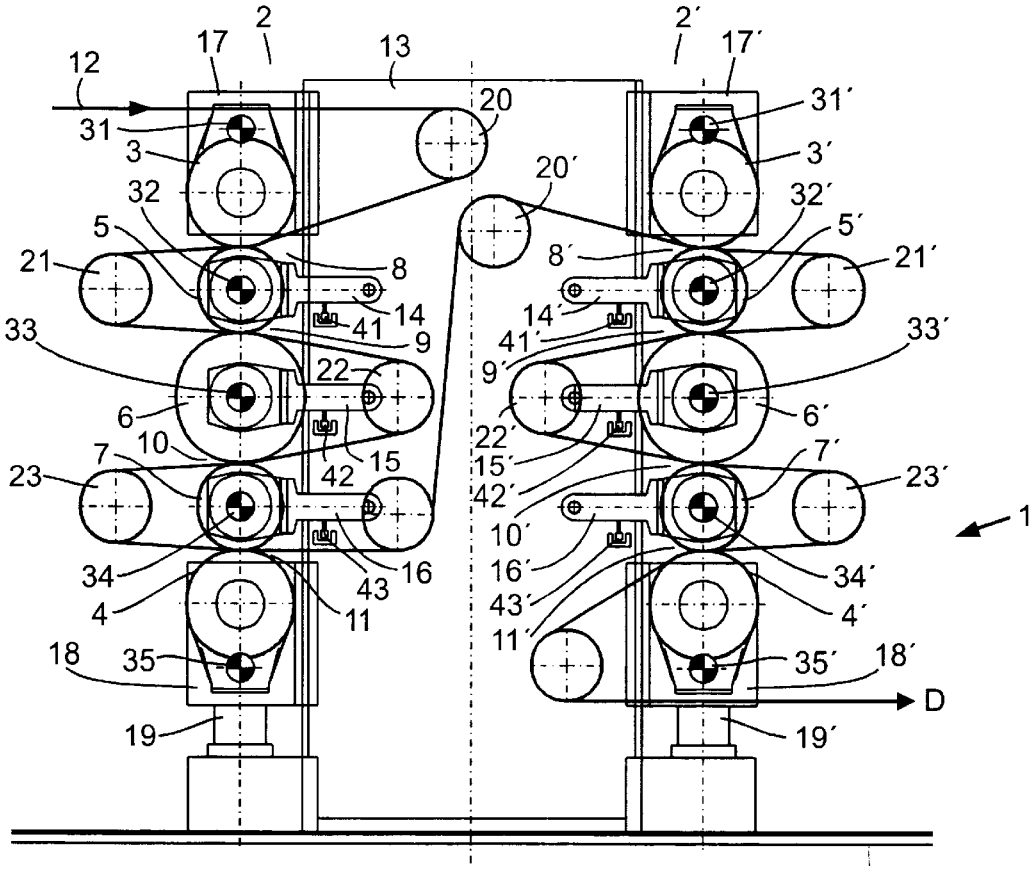
Figure 3:
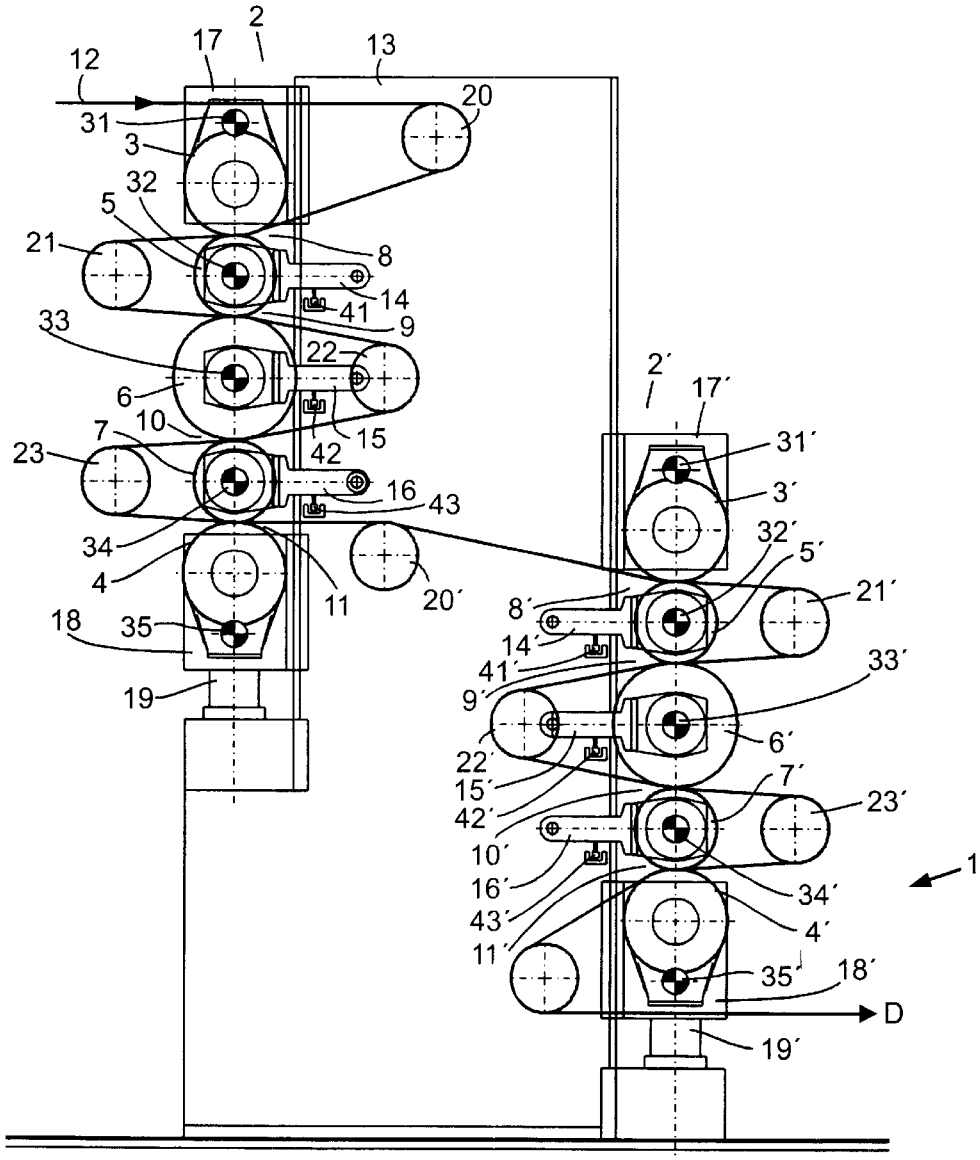
Figure 4:
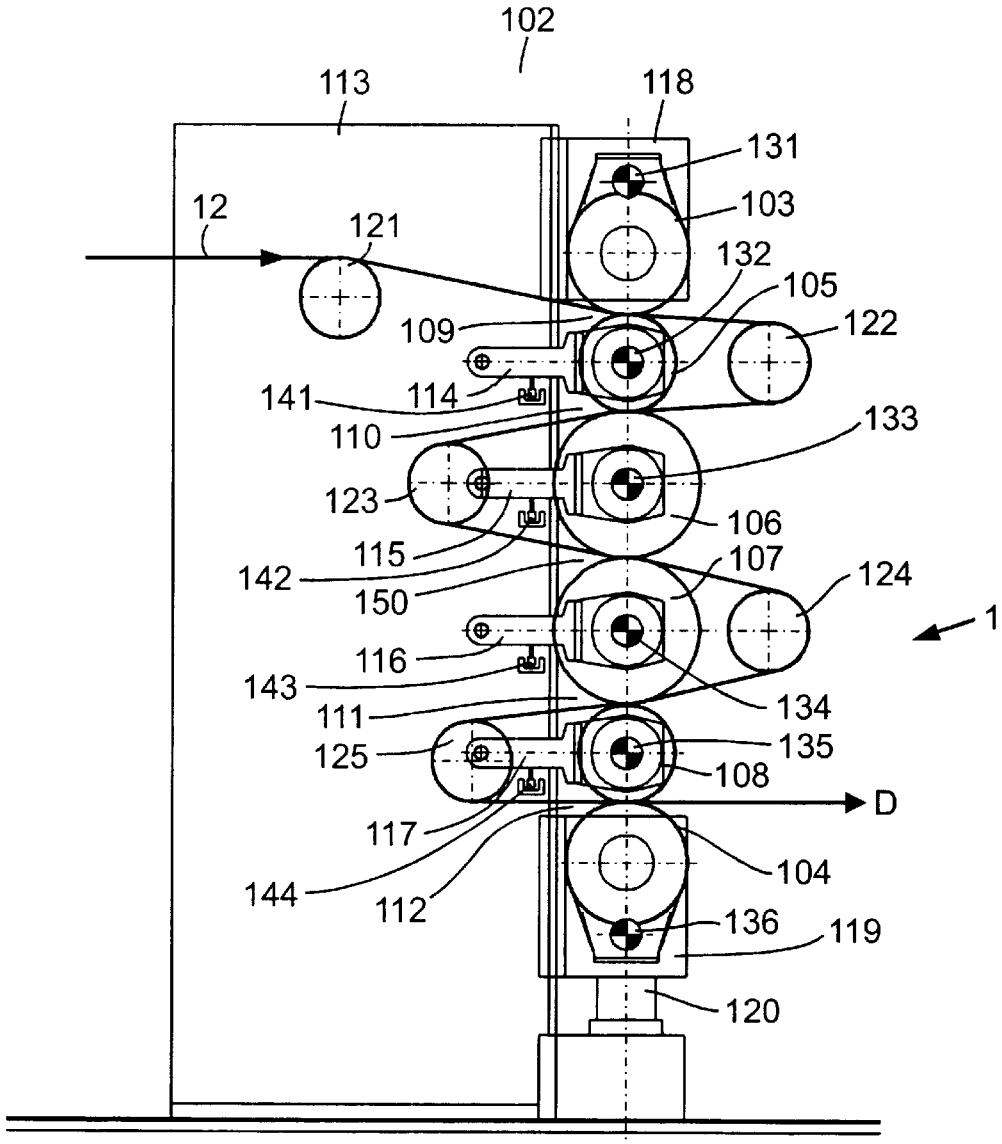
Figure 5:
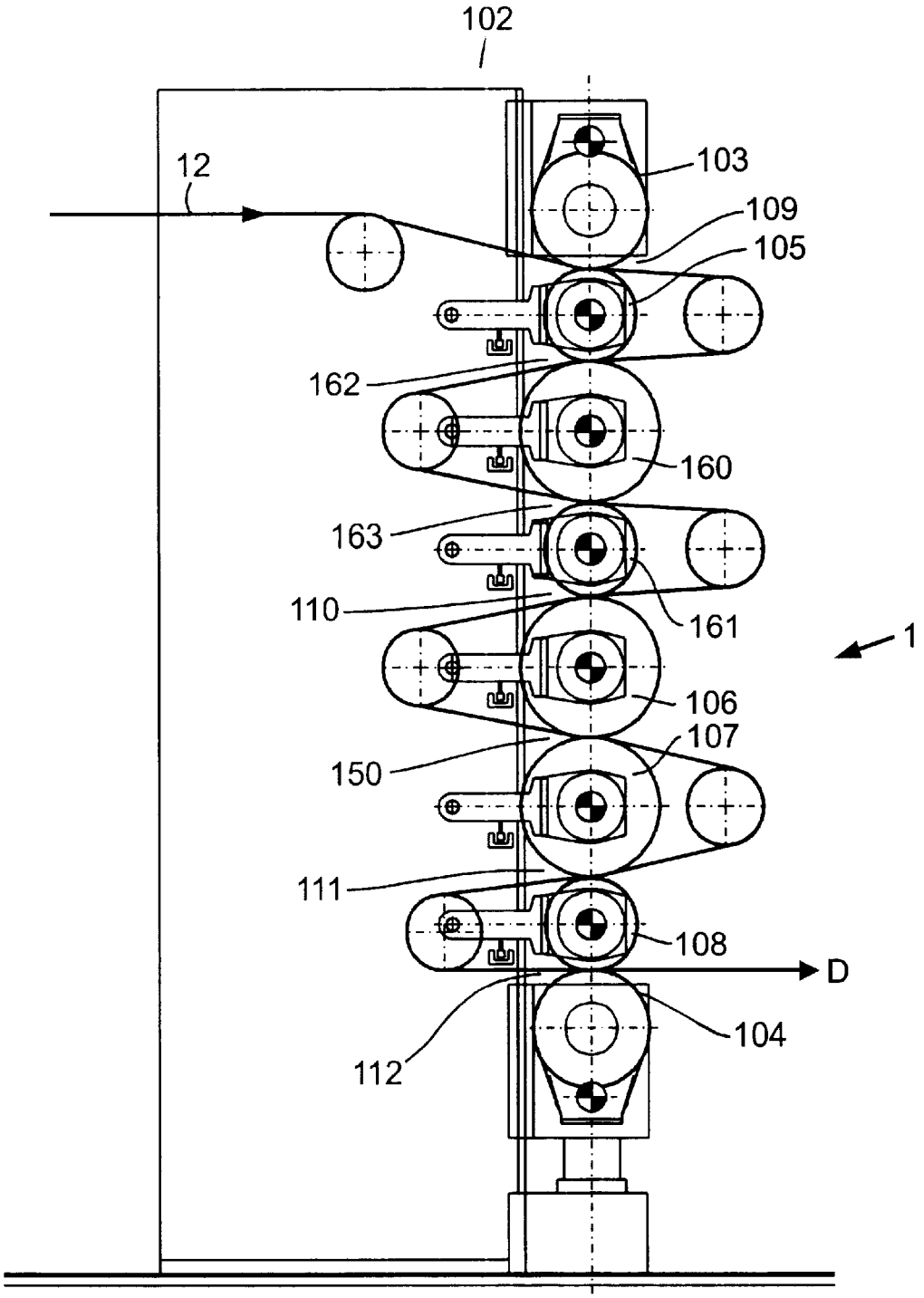

The invention will be explained in more detail below using the exemplary embodiments illustrated in the appended figures, in which FIG. 1 shows, in schematic form, the side view of a first exemplary embodiment of a calender for the one-side treatment of a paper web, FIG. 2 shows, in schematic form, the side view of a second exemplary embodiment of a calender for the two-side treatment of a paper web, FIG. 3 shows, in schematic form, the side view of a third exemplary embodiment of a calender for the two-side treatment of a paper web, FIG. 4 shows, in schematic form, the side view of a fourth exemplary embodiment of a calender for the two-side treatment of a paper web, FIG. 5 shows, in schematic form, the side view of a fifth exemplary embodiment of a calender for the two-side treatment of a paper web.

FIG. 1 shows a calender 1 for treating a paper web, in particular for papers with medium up to high demands on surface smoothness and gloss. For this purpose, the calender 1 comprises a roll stack 2 which can be loaded from the end, having a top end roll 3 and a bottom end roll 4 and a plurality of intermediate rolls 5, 6, 7 which are jointly arranged in a roll stack plane. The roll stack 2 according to FIG. 1 comprises three intermediate rolls 5, 6, 7 and therefore comprises five rolls 3 to 7, which are arranged in a vertical roll stack plane. Alternatively, the roll stack plane may be inclined or horizontal. Formed between two of the rolls 3 to 7 in each case are nips 8, 9, 10, 11, through which the paper web 12 runs in a direction D.

In order to form nips in the form of soft nips, in which a hard and a soft roll define a nip, the rolls 3 to 7 are constructed as hard and soft rolls, according to FIG. 1 the top end roll 3 being a soft roll, the top intermediate roll 5 being a hard roll, the central intermediate roll 6 being a soft roll, the bottom intermediate roll 7 being a hard roll and the bottom end roll 4 being a soft roll. The nips 8 to 11 are therefore all soft nips, in which the paper web 12 running through the roll stack 2 is calendered. Since in each case only the bottom side of the paper web 12 comes into contact with the hard rolls 5, 7 in the nips 8, 9, 10, 11 and experiences calendering there, the roll stack 2 is used for the one-side treatment of a paper web.

The soft rolls 3, 4, 6 are rolls with a resilient cover, whose material can be selected in accordance with the intended use. The diameter of the soft intermediate roll 6 is greater than the diameter of the soft end rolls 3, 4. The diameter of a soft intermediate roll 6 is preferably 1.1 to 1.5 times the diameter of a soft end roll 3, 4. The diameters of the two soft end rolls 3, 4 can be identical in this case. In particular, depending on the web running speed, the diameter of a soft intermediate roll 6 can be selected in such a way that the loadings frequency is 20 to 25 Hz.

The rolls 3 to 7 are fixed to a calender frame 13. The fixing is provided by bearing devices on which lever guides 14, 15, 16, like those illustrated for the intermediate rolls 5 to 7, or sliding guides 17, like those illustrated for the end rolls 3, 4, can act. In order to open and close the roll stack 2, the rolls 3, 4, 5, 6, 7 can be loaded at least from one end. In order to close the roll stack 2, a hydraulic cylinder 19 is provided here, and can also be used for loading the roll stack 2. The top end roll 3 is then arranged to be stationary.

Each roll 3 to 7 is preferably provided with its own high-performance or power drive 31 to 35.

The top end roll 3 and the bottom end roll 4 are additionally preferably constructed as deflection controlled rolls. In order to set individual linear loads, independent from the dead weight of the rolls 3 to 7, loading or relief devices 41, 42, 43 can be provided, which act on the lever guides 14, 15, 16 of the intermediate rolls.

In order to guide the paper web 12 through the nips 8 to 11, guide rollers 20, 21, 22, 23 are provided. The roll stack 2 can be used on-line or off-line in relation to a paper machine.

All the hard rolls and, if necessary, the soft rolls can be temperature-controlled or heated.

In order to calender the second side of the paper web 12, according to FIG. 2 a second roll stack 2' can be provided, which is connected behind the roll stack 2 and through which the paper web 12 runs from top to bottom, as in the first roll stack 2. By transferring the paper web 12 from the first roll stack 2 to the second roll stack 2' the side of the paper web which is calendered is now changed. In the second roll stack 2', the side of the paper web 12 which in each case comes into contact with the hard rolls in the nips is in turn calendered. The second roll stack 2' is preferably built up in exactly the same way as the first roll stack 2, so that for the same components, the same reference symbols provided with a prime symbol are used. The present explanations relating to the roll stack 2 therefore apply appropriately to the roll stack 2'.

The exemplary embodiment of a calender 1 shown in FIG. 3 differs from the exemplary embodiment of a calender 1 shown in FIG. 2 only in the fact that the second roll stack 2' is arranged with a vertical offset in relation to the first roll stack 2. The two roll stacks 2, 2' are preferably arranged one behind the other with a vertical offset such that at least only the topmost nip 8' of the second roll stack 2' is higher than the lowest nip 11 of the first roll stack 2. This achieves the situation where, while maintaining adequate tension in the paper web, the straightest possible guidance, and therefore also the shortest guidance, of the paper web 12 in the reversing nip between the first and second roll stack is achieved.

FIG. 4 shows a calender 100 for the two-side treatment of a paper web 12, in particular a paper which is to be calendered to medium up to high smoothness and gloss, with a roll stack 102 having a reversing nip 150. The roll stack 102 can be loaded at least from one end and comprises a top end roll 103 and a bottom end roll 104 and a plurality of intermediate rolls 105, 106, 107, 108, which are jointly arranged in a roll stack plane. The roll stack 102 according to FIG. 4 comprises four intermediate rolls 105, 106, 107, 108 and therefore comprises six rolls, which are arranged in a vertical roll stack plane. Alternatively, the roll stack plane may run at an angle or horizontally. Formed between two of the rolls 103 to 108 in each case are nips 109, 110, 150, 111, 112, through which the paper web 12 runs in a passage direction D.

In order to form nips in the form of soft nips, in which a hard and a soft roll bound a nip, the rolls 103 to 108 are constructed as hard and soft rolls, according to FIG. 4 the top end roll 103 being a soft roll, the top intermediate roll 105 being a hard roll, two central intermediate rolls 106 107 each being a soft roll, the bottom intermediate roll 108 being a hard roll and the bottom end roll 104 being a soft roll. The nips 109, 110, 111 and 112 are therefore all soft nips between a hard and a soft roll, in which in each case the paper web 12 running through the roll stack 2 is calendered in particular on the side which comes into contact with a hard roll. The reversing nip 150 is formed between the two soft intermediate rolls 106, 107 and leads to the situation where, in the nips 111 and 112 the other side of the paper web comes into contact with the respective hard roll 108 for the purpose of two-side calendering of the paper web in one roll stack 102.

The soft rolls 103, 104, 106, 107 are rolls with a resilient cover, whose material can be selected in accordance with the intended use. The diameter of the two soft intermediate rolls 106, 107 is in each case greater than the diameter of the soft end rolls 103, 104. The diameter of a soft intermediate roll 106, 107 is preferably 1.1 to 1.5 times the diameter of a soft end roll 103, 104. The diameters of the two soft end rolls 103, 104 can be identical in this case. In particular, depending on the web running speed, the diameter of a soft intermediate roll 106, 107 can be selected in such a way that the rolling frequency is 20 to 25 Hz.

The rolls 103 to 108 are fixed to a calender frame 113. The fixing is provided by bearing devices, on which lever guides 114, 115, 116, 117 like those illustrated for the intermediate rolls 105 to 108, or sliding guides 118, 119, like those illustrated for the end rolls 103, 104, can act. In order to open and close the roll stack 102, the rolls can be loaded at least from one end. In order to close the roll stack 102, a hydraulic cylinder 120 is provided here, and can also be used for loading the roll stack 102. The top end roll 103 is then arranged to be stationary.

Each roll 103 to 108 is preferably provided with its own high-performance or power drive 131 to 136.

The top end roll 103 and the bottom end roll 104 are additionally preferably constructed as deflection controlled rolls. In order to set individual linear loads, freed from the dead weight of the rolls 3 to 7, loading or relief devices 141, 142, 143, 144 can be provided, which act on the lever guides 114, 115, 116, 117 of the intermediate rolls.

In order to guide the paper web 12 between the nips 8 to 11, guide rollers 121, 122, 123, 124, 125 are provided. The roll stack 102 can be used on-line or off-line in relation to a paper machine All the hard rolls and, if necessary, the soft rolls can be temperature-controlled or heated.

The exemplary embodiment shown in FIG. 5 differs from the exemplary embodiment described and shown in FIG. 4 in the fact that the roll stack 102 comprises eight rolls, that is to say two further intermediate rolls 160, 161, which increases the number of rolls above the reversing nip 150. The intermediate roll 160 is a soft roll, to which that which was stated previously for the soft intermediate rolls 106, 107 applies appropriately. The intermediate roll 161 is constructed as a hard roll. The additional soft nips 162, 163 which result in this way increase the calendering of the side of the paper web to be treated upstream of the reversing nip 150. Otherwise, the explanations above apply accordingly.

All publications and patent applications mentioned in this specification are herein incorporated by reference to the same extent as if each individual publication or patent application was specifically and individually indicated to be incorporated by reference.

The invention now being fully described, it will be apparent to one of ordinary skill in the art that many changes and modifications can be made thereto without departing from the spirit or scope of the appended claims.

What is claimed is:

1. A calender for treating a paper web, said calendar comprising at least one roll stack having a top end and a bottom end, wherein said roll stack loaded with an external force from at least one of the ends, said roll stack further comprising a top end roll, a bottom end roll and a plurality of intermediate rolls, said rolls being jointly arranged in a roll stack plane, said rolls including hard rolls and soft rolls forming soft nips between each hard roll and soft roll, wherein each intermediate roll which is soft has a greater diameter than each end roll which is soft.

2. The calendar as claimed in claim 1, wherein the diameter of each soft intermediate roll is 1.1 to 1.5 times the diameter of each soft end roll.

3. The calendar as claimed in claim 1 or 2, wherein all the rolls have their own high-performance drive.

4. The calendar as claimed in claim 1 wherein, each soft intermediate roll has a diameter chosen to obtain a rolling frequency in the range from 20 to 25 Hz.

5. The calendar as claimed in claim 1 wherein the linear loads in the individual soft nips of a roll stack can be set in accordance with an individual characteristic curve.

6. The calendar as claimed in claim 1, comprising two-roll stacks connected one after the other.

7. The calendar as claimed in claim 6, wherein the two roll stacks connected one after the other each comprise five rolls, and the top and bottom end rolls of each roll stack are soft rolls.

8. The calendar as claimed in claim 6, wherein the two roll stacks are arranged one after the other with a vertical offset, at least the topmost nip of the second roll stack being higher than the lowest nip of the first roll stack.

9. The calendar as in claim 1 wherein, for the two-side treatment of the paper web, the at least one roll stack comprises six or eight rolls, with the top and bottom end rolls being soft rolls and a reversing nip being formed between two soft intermediate rolls.

* * * * *